US008382176B2

(12) United States Patent
Meza

(10) Patent No.: US 8,382,176 B2
(45) Date of Patent: Feb. 26, 2013

(54) VAULT COVER MOVER

(76) Inventor: Arturo Meza, Huntington Park, CA (US)

( * ) Notice: Subject to any disclaimer, the term of this patent is extended or adjusted under 35 U.S.C. 154(b) by 118 days.

(21) Appl. No.: 13/118,720

(22) Filed: May 31, 2011

(65) Prior Publication Data

US 2012/0306224 A1 Dec. 6, 2012

(51) Int. Cl.
*B66C 1/00* (2006.01)
*B66C 1/54* (2006.01)

(52) U.S. Cl. ..... 294/97; 294/89; 59/86

(58) Field of Classification Search ..... 294/97, 294/89, 62, 63.1, 15, 16; 59/86
See application file for complete search history.

(56) References Cited

U.S. PATENT DOCUMENTS 485,944 A * 11/1892 Jones ..... 294/97
2,305,320 A * 12/1942 Rea ..... 294/97
2,331,566 A * 10/1943 Pautz ..... 452/189
4,460,210 A * 7/1984 Miechur ..... 294/97
4,538,850 A * 9/1985 De Vito ..... 294/89

* cited by examiner

*Primary Examiner* — Dean Kramer
*Assistant Examiner* — Stephen Vu
(74) *Attorney, Agent, or Firm* — Steven A. Nielsen; Allman & Nielsen, P.C.

(57) ABSTRACT

A vault cover grabber, bolt cover lifter or vault cover eye-hook is formed from two L shaped components with each component having an eye opening on one end and each component having an L shaped end (lower end) designed to be inserted through a void of a vault cover or other object. The top ends or eye ends of the two components are pivoted apart to allow the two lower ends to pass through a vault cover void. After insertion, the upper eye ends are pivoted together, causing the two lower ends to contain the vault cover. A hook or other object is placed through the two eye voids of the top ends of the two components. A combination of double clevis connectors, shaft collars, shackles and chains secure the vault cover grabber to a handle or other means of lifting.

16 Claims, 7 Drawing Sheets

VAULT COVER MOVER

BACKGROUND OF THE INVENTION

(1) Field of the Invention

The invention generally relates to means and methods of lifting or otherwise moving manhole covers, vault covers and similar items. More particularly, the invention relates to a scissors type eye bolt assembly used to penetrate vault cover voids and then secure vault covers for ease of lifting.

BRIEF SUMMARY OF THE INVENTION

The present invention overcomes shortfalls in the related art by presenting an unobvious and unique combination, configuration and use of attachment components to efficiently secure and lift a vault cover, manhole cover or other type of object. In the known prior art, workers would pry vault covers from their seated position using pry bars and then drag or carry the covers to a new location. The known prior art lead to back aches, injured fingers and damaged asphalt.

The present invention presents unexpected results in attachment efficiency and in safety. In one embodiment a scissors eye bolt assembly is placed in a narrow position, inserted into a vault void, spread into an open position and then attached to a chain. The chain is fitted with a handle allowing a person to lift the vault without use of a crowbar. The disclosed scissor eye bolt assemblies securely attached to a vault cover and provide new means of attachment.

REFERENCE NUMERALS IN THE DRAWINGS

Figure 1:
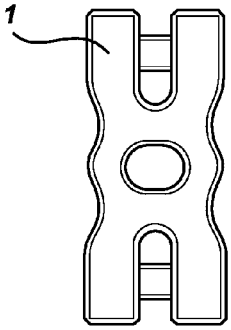
FIG. 1 is a plan view of a double clevis connector

1 a double clevis connector
2 a shaft collar
3 a shaft collar securing screw

4 a safety hook
5 a shackle
6 single handle
7 a length of chain
8 a scissors eye bolt assembly
9 vault cover, manhole cover or other object to be lifted
10 void within a vault cover or other object to be lifted
11 a double tee bar
12 connector pin of a scissors eye bolt assembly 8
13 a scissors eye bolt assembly in a closed position ready for insertion into a void
14 a scissors eye bolt assembly is a half closed position
15 a scissors eye bolt assembly in an open position, with the hole clamps or eye voids in position to accept a safety hook
16 hole clamps or eye voids, used to accept a safety hook or other object
17 lower legs of a scissors eye bolt assembly
18 upper legs of a scissors eye bolt assembly
19 support area of lower leg 17 of scissors eye bolt assembly
100 a general embodiment of the invention in use These and other aspects of the present invention will become apparent upon reading the following detailed description in conjunction with the associated drawings. The present invention overcomes shortfalls in the related art by combining directional microphone solution with an adaptive noise cancellation algorithm. Economies in hardware and power consumption are obtained by two microphones sharing the front-end hardware. These modifications, other aspects and advantages will be made apparent when considering the following detailed descriptions taken in conjunction with the associated drawings.

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

All the above references and U.S. patents and applications are incorporated herein by reference. Aspects of the invention can be modified, if necessary, to employ the systems, functions and concepts of the various patents and applications described above to provide yet further embodiments of the invention.

These and other changes can be made to the invention in light of the above detailed description. In general, the terms used in the following claims, should not be construed to limit the invention to the specific embodiments disclosed in the specification, unless the above detailed description explicitly defines such terms. Accordingly, the actual scope of the invention encompasses the disclosed embodiments and all equivalent ways of practicing or implementing the invention under the claims.

While certain aspects of the invention are presented below in certain claim forms, the inventor contemplates the various aspects of the invention in any number of claim forms.

Referring to FIG. 1, a double clevis connector 1 is shown in isolation from other parts. The double clevis connector 1 may include two securing pins wherein the securing pins are inserted into chain links. The two securing pins may be held in place by use of carter pins.

Figure 2:
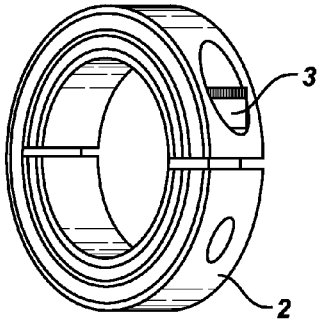
FIG. 2 is a perspective view of a shaft collar
Figure 6:
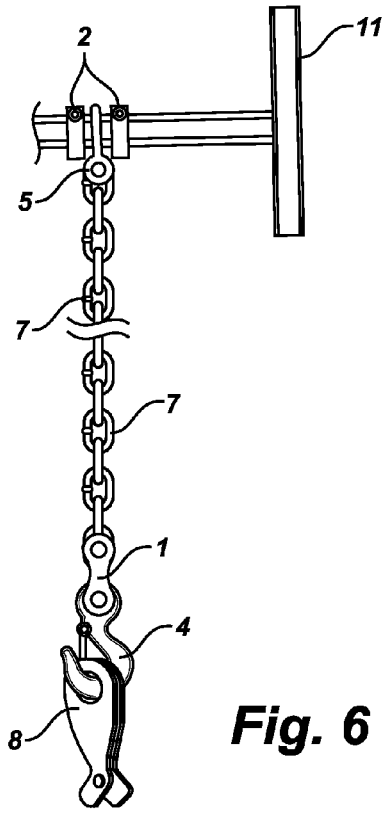
FIG. 6 is a perspective view of one embodiment of the invention
FIG. 7 provides three views of a disclosed scissors eye bolt assembly

Referring to FIG. 2, a shaft collar 2 is shown in isolation. A shaft collar may be in the form of a single or double split configuration and may have a shaft collar securing screw 3 used to tighten or adjust the shaft collar. Two shaft collars may be used upon a tee bar to secure a shackle as shown in FIG. 6.

Figure 3:
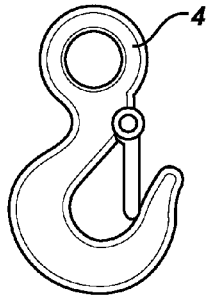
FIG. 3 is a plan view of a safety hook

Referring to FIG. 3, a safety hook 4 is shown in isolation. In the preferred embodiment, the safety hook 4 is rated to hold ¾ of a ton. A safety hook 4 or other object may be used to secure the two hole clamps or eye voids of a scissors eye bolt assembly as shown in the lower section of FIG. 6.

Figure 4:
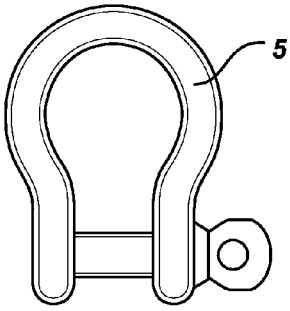
FIG. 4 is a plan view of a shackle

Referring to FIG. 4, a shackle 5 is shown in isolation. The shackle may be a screw pin type, chain screw type or other type. A shackle 5 is shown securing chain to a tee handle in the top section of FIG. 6.

Figure 5:
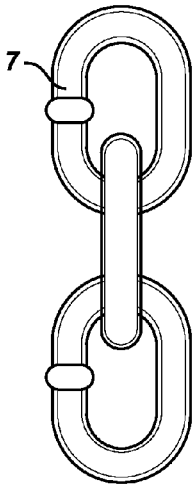
FIG. 5 is a plan view of a section of chain

Referring to FIG. 5, a section of chain 7 is shown. In the preferred embodiment the chain is sized of 0.25".

Referring to FIG. 6, a section of a tee bar embodiment is shown with a tee bar 11 in connection with a shackle 5, with two shaft collars on either side of the shackle. The two shaft collars prevent the shackle from sliding upon the tee bar 11.

A section of chain 7 is connected to the shackle 5 and the lower end of the chain is connected to a double clevis connector 1 and a safety hook 4 is attached to the double clevis connector. The safety hook 4 is shown inserted within the eye voids or hole clamps of a scissors eye bolt assembly 8. In FIG. 6 the scissors eye bolt assembly is shown in a position used to lift a vault or other object, as the lower legs of the scissors eye bolt assembly are spread apart, so as to not slip through a vault void.

Figure 7:
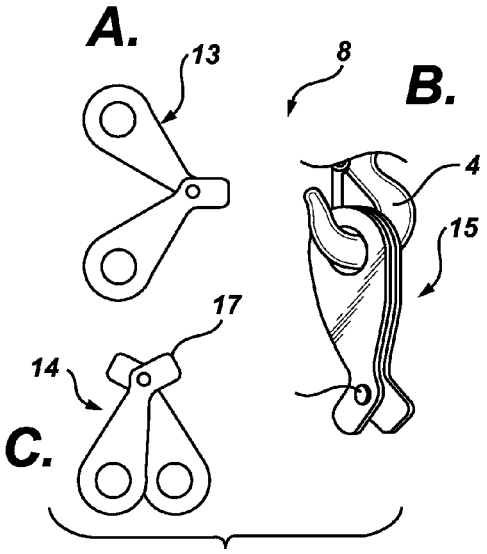

Referring to FIG. 7, three views are presented of a scissors eye bolt assembly. A scissors eye bolt assembly is shown in closed position 13, ready for insertion into a void. A scissors eye bolt assembly is shown in a half closed position 14. A scissors eye bolt assembly is shown in an open position 15, with a safety hook 4 inserted within the eye voids of the scissors eye bolt assembly.

Figure 8:
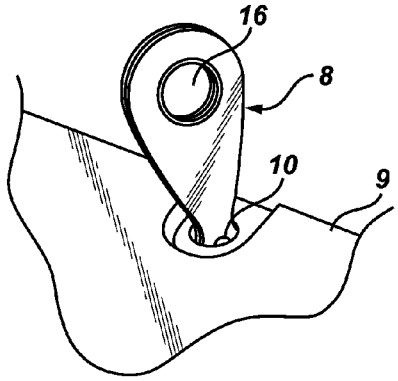
FIG. 8 is a perspective view of a scissors eye bolt assembly inserted through a vault void

FIG. 8 shows a scissors eye bolt assembly 8 in an open position and inserted through a void 10 of a vault cover 9, manhole cover or other object to be lifted. Both eye voids 16 or hole clamps are aligned so as to accept a safety hook or other object.

Figure 9:
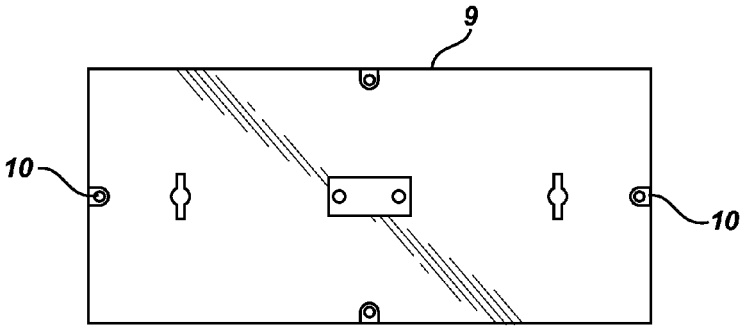
FIG. 9 is a plan view of a vault cover

FIG. 9 shows a vault cover 9 with voids 10. The voids are sometimes used to by a scissors eye bolt assembly to secure the vault.

Figure 10:
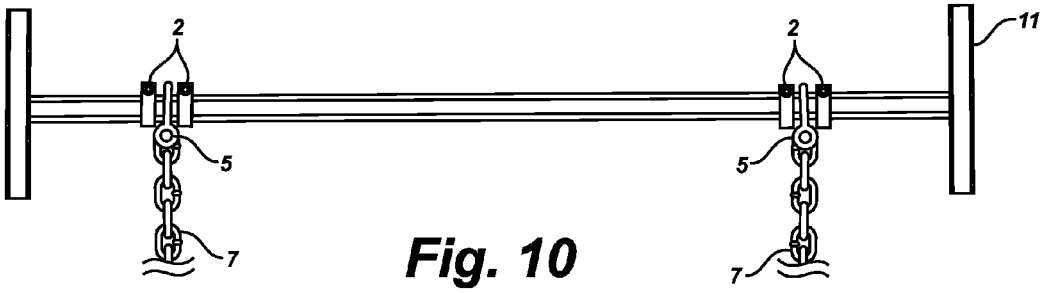
FIG. 10 is a perspective view of double tee bar attached to chains

FIG. 10 is a tee bar embodiment wherein a tee bar 11 may be used by two or more persons to lift a vault or other object. The tee bar 11 is shown with two handles and is attached to two shaft collars 2 which contain a shackle and wherein a chain 7 is attached to the shackle.

Figure 11:
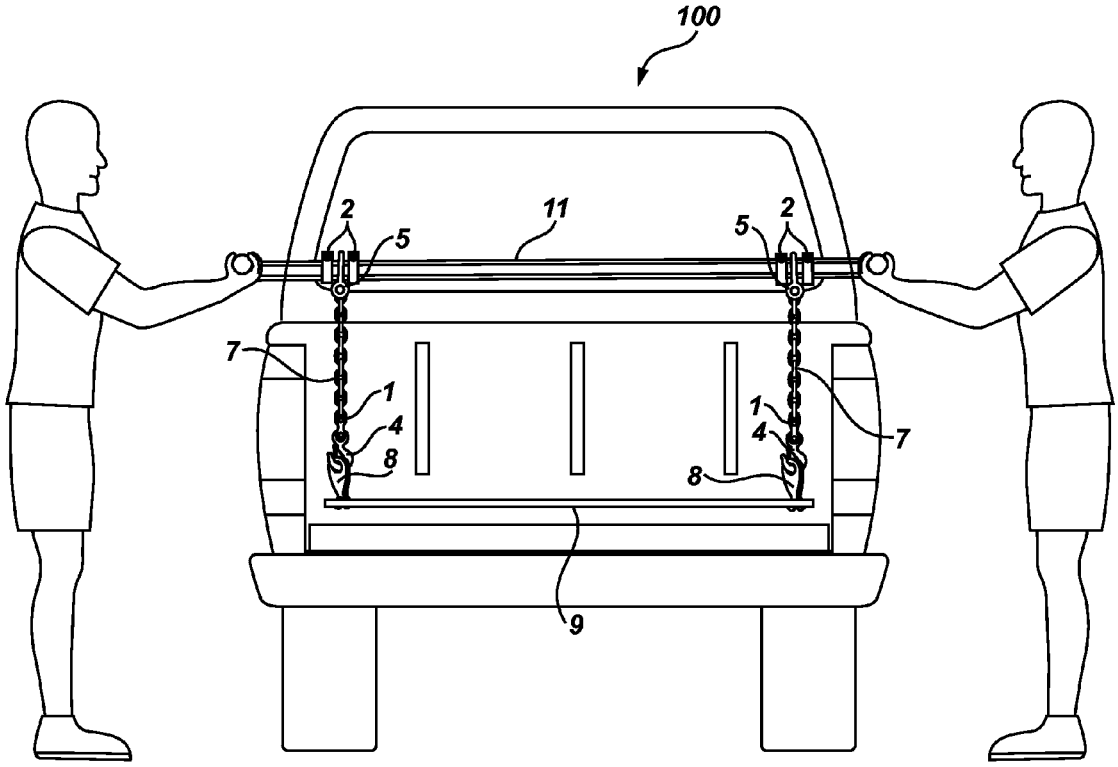
FIG. 11 is a perspective view of two people using a tee bar embodiment of the invention

FIG. 11 shows a tee bar embodiment in use by two people who are each lifting a tee bar 11. Near the two lifters, the tee bar 11 is shown with two handles and is attached to two shaft collars 2 which contain a shackle and wherein a chain 7 is attached to the shackle. Toward the lower end, a chain 7 is attached to a double clevis connector 1 and a safety hook 4 is attached to the lower section of the double clevis connector. A safety hook 4 secures a scissors eye bolt assembly 8 and the lower legs of the scissors eye bolt assembly secure a vault cover 9.

Figure 12:
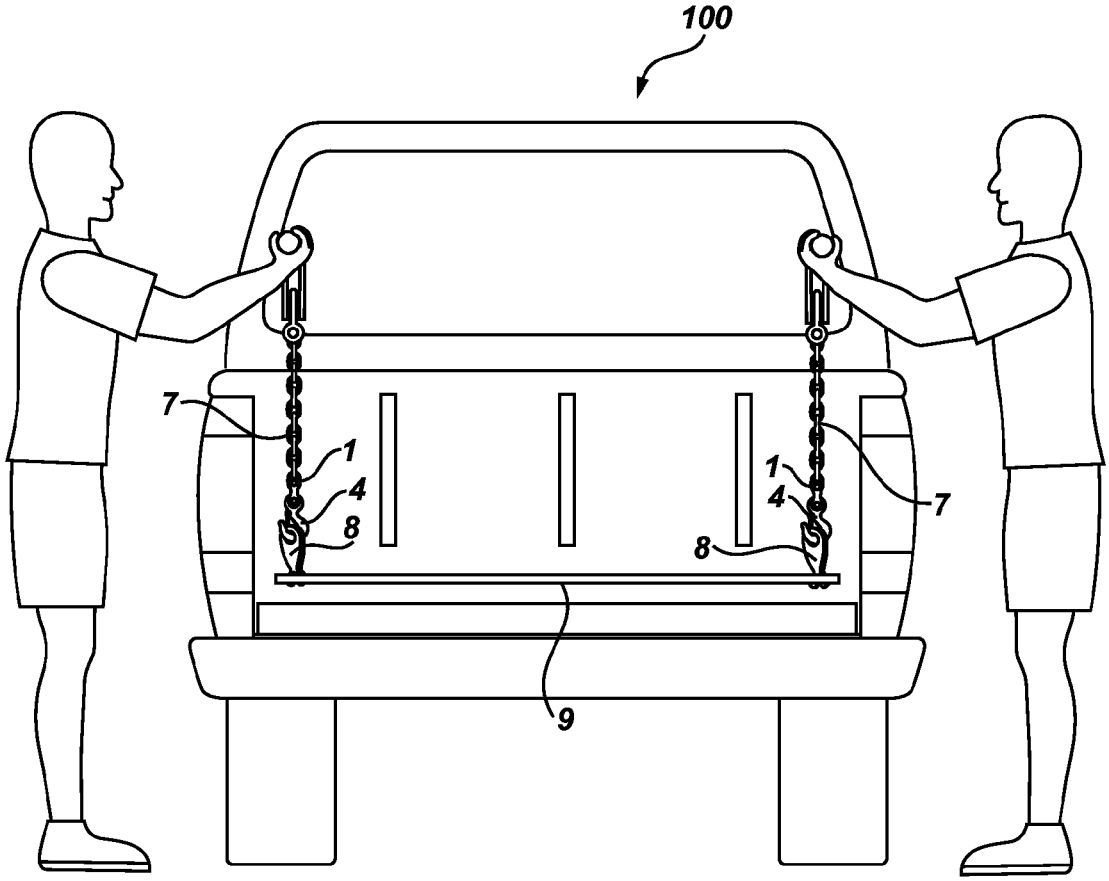
FIG. 12 is a perspective view of two people using a hand bar embodiment of the invention

FIG. 12 is analogous to FIG. 11; however, the two lifters are using single handles 6 to lift an embodiment of the invention.

Figure 13:
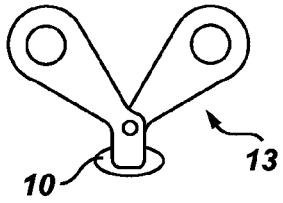
FIG. 13 is a perspective view of a scissors eye bolt assembly in a closed position ready for insertion

FIG. 13 is scissors bolt assembly shown in a closed position 13, being in position to travel down a void 10. In the closed position both hole clamps or eye voids are spread apart.

Figure 14:
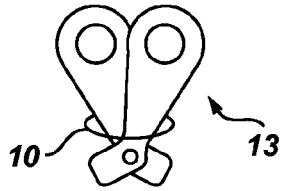
FIG. 14 is a perspective view of a scissors eye bolt assembly in an open position, ready to lift a vault

FIG. 14 presents a scissors bolt assembly in a half closed position 14. The lower legs can be seen to spread apart.

Figure 15:
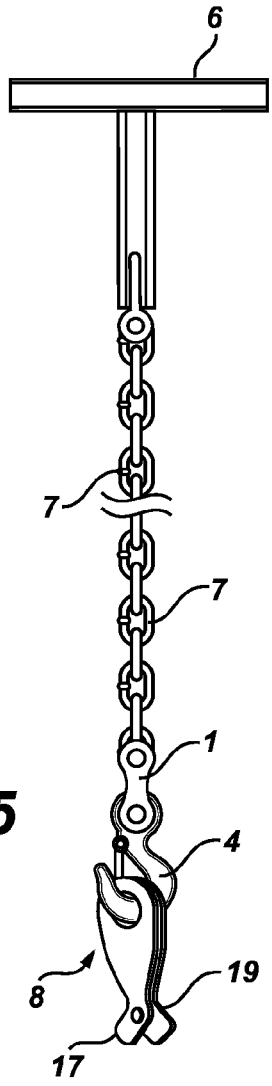
FIG. 15 is a perspective view of a hand bar embodiment of the invention

FIG. 15 presents a single handle embodiment with a single handle 6 is secured to a chain 7 and a double clevis connector 1 is secured to the lower portion of the chain. A safety hook 4 is attached to the double clevis connector and to a scissors eye bolt assembly 8. The shown scissors eye bolt assembly has both eye voids lined up to receive a safety hook. A support area 19 of the lower leg 17 is shown. The support area may be used to support a vault cover, as shown in FIG. 16.

Figure 16:
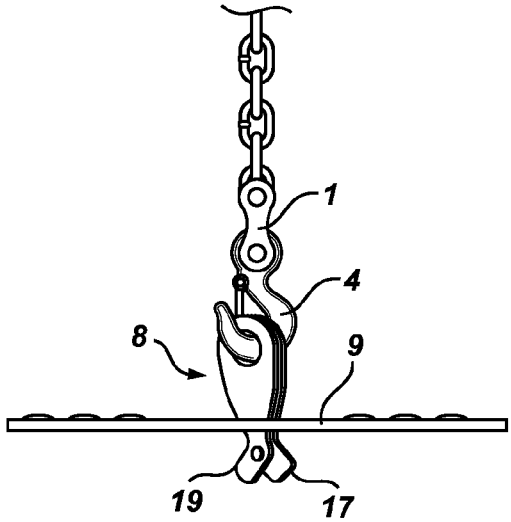
FIG. 16 is a perspective view of a scissors eye bolt assembly securing a vault cover

FIG. 16 shows a vault cover 9 being supported by a scissors eye bolt assembly, and more particularly a support area 19 of the lower leg supports the vault cover.

Figure 17:
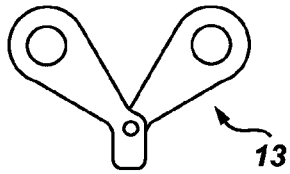
FIG. 17 is a perspective view of a scissors eye bolt assembly in a closed position, ready for insertion

FIG. 17 shows a scissors eye bolt assembly in an open position 13 wherein the eye voids are opened up from each other and the lower legs are in position to enter a void.

Figure 18:
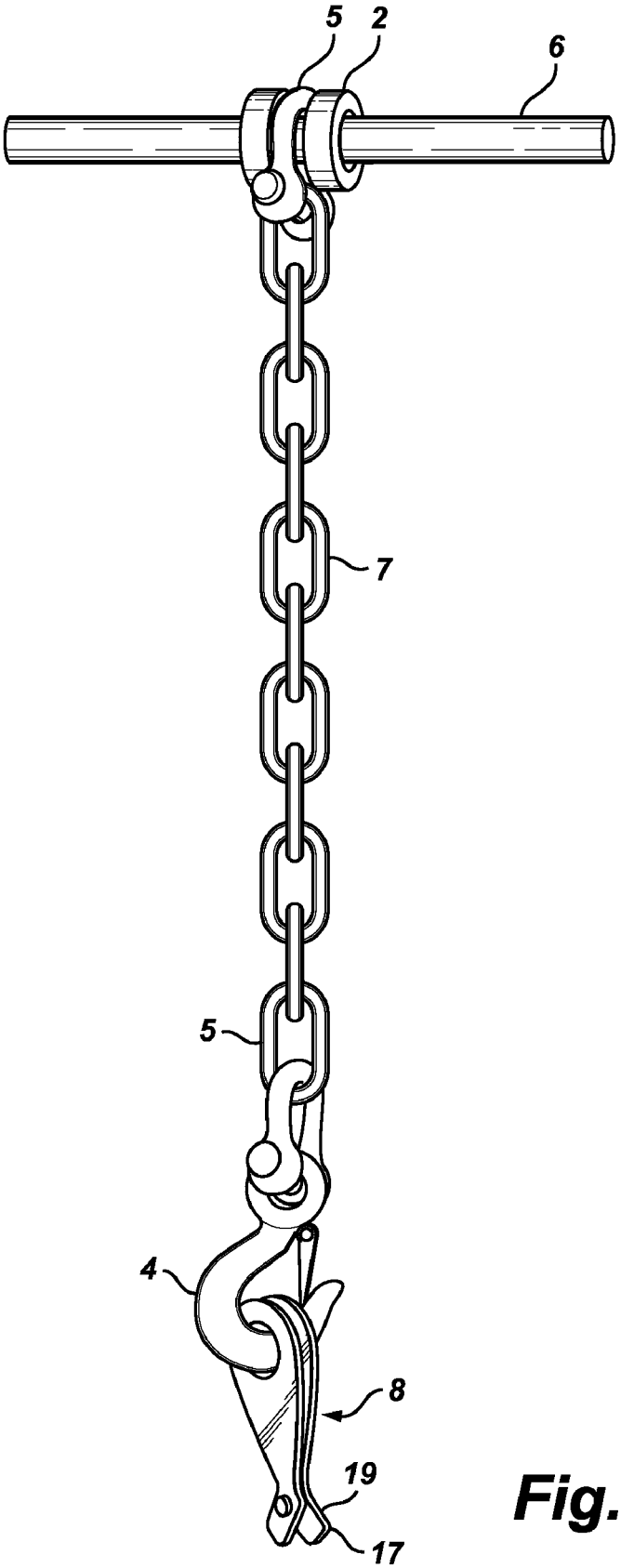
FIG. 18 is a perspective view of a hand bar embodiment of the invention with the scissors eye bolt assembly attached to a safety hook

FIG. 18 presents a full view off single handle embodiment wherein a single handle 8 is secured by a shackle 5 and two shaft collars 2 flank the shackle to prevent the shackle from sliding off of the single handle. A length of chain 7 is secured to the shackle 5 and on the chain's lower end, secured to a double clevis connector, or the shown shackle. The shackle secures a safety hook 4 which in turn holds a scissors eye bolt assembly 8. The scissors eye bolt assembly is shown with a set of lower legs 17 and with each lower leg having a support area 19 sometimes used to support a vault or other object.

Figure 19:
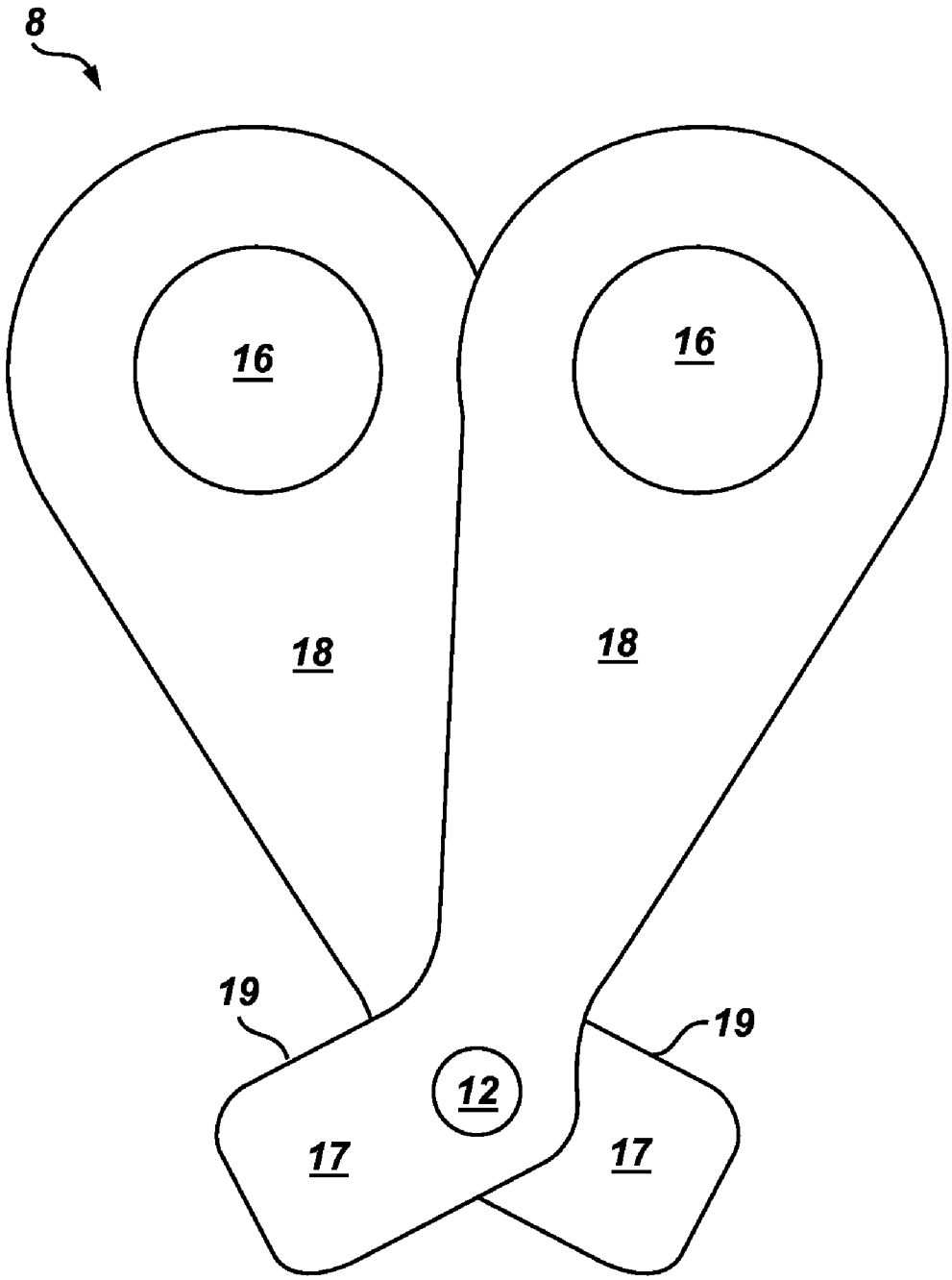
FIG. 19 depicts a scissors eye bolt assembly

FIG. 19 presents an enlarged view of a scissors eye bolt assembly 8. Each half of a scissors eye bolt assembly comprises an upper leg 18 which holds an eye void 16. Each half also comprises a lower leg 17, which includes a support area 19, sometimes used to support vault or other object. In normal use, support areas 19 are placed into use when the two eye voids 16 are aligned and secured to a safety hook or other object. A connector pin 12 attached the two halves of the scissors eye bolt assembly.

Items.

Embodiments or features of this disclosure include, but are not limited to the following items.

Item 1. A device 100 for securing and lifting a vault cover 9, the device comprising:

a) a scissors eye bolt assembly having two halves, with each half comprising an upper leg 19 with the upper leg containing an eye void 16, a lower leg 17 with each lower leg comprising a support area 19, and wherein the two halves are pivotally connected within the lower leg areas 17 by use of a connector pin 12;

b) the angles between the upper legs 18 and lower legs 17 and position of the connector pin 12 being such that when the two eye voids 16 are aligned, the two support areas 19 of the lower legs are in position to support an item; and c) the angles between the upper legs 18 and lower legs 17 and position of the connector pin 12 being such that the two upper legs 18 may be spread apart to allow the lower legs 17 to come into alignment, allowing the lower legs to enter a void area, with the void area having a diameter smaller than the diameter of the support areas of the lower legs created when the eye voids 16 are aligned.

Item 2. The device of item 1 further comprising a safety hook 4 inserted into the two eye voids 16 of the scissors eye bolt assembly.

Item 3. The device of item 2 further comprising a double clevis connector 1 attached to the safety hook and with the double clevis connector attached to a length of chain 7.

Item 4. The device of item 3 further comprising a shackle attached to an upper end of the chain 7 and with the shackle also attached to a single handle 6.

Item 5. The device of item 4 further comprising two or more shaft collars 2 flanking the shackle 5 and wherein the two or more shaft collars are attached to the single handle.

Item 6. The device of item 5 wherein a tee bar 11 is used in place of a single bar 6.

What is claimed is:

1. A device for securing and lifting a vault cover or other object, the device comprising:

a) a scissors eye bolt assembly having two halves, with each half comprising:

i. an upper leg with the upper leg containing an eye void, ii. a lower leg with the lower leg comprising a support area, wherein the two halves of the scissor eye bolt assembly are pivotally connected within the support areas of the lower leg by use of a connector pin; a configuration of the upper legs with respect to the lower legs being such that when the two eye voids are aligned, the two support areas of the lower legs are in position to support an object to be lifted; the configuration of the upper legs with respect to the lower legs being such that the two upper legs may be spread apart to allow the lower legs to come into alignment, allowing the lower legs to enter a void area defined by the object to be lifted, with the void area having a diameter smaller than the diameter of the support areas of the lower legs created when the eye voids are aligned; and b) a safety hook inserted into the eye voids.

2. The device of claim 1, further comprising a double clevis connector attached to the safety hook and with the double clevis connector attached to a length of chain.

3. The device of claim 2, further comprising a shackle attached to an upper end of the chain and with the shackle also attached to a single handle.

4. The device of claim 3, further comprising two or more shaft collars flanking the shackle and wherein the two or more shaft collars are attached to the single handle.

5. The device of claim 4, wherein a tee bar is used in place of the single handle.

6. The device of claim 5, wherein the tee bar is attached to two chains and each of the chains is attached to the scissors eye bolt assembly.

7. A method for moving an object, the method comprising the steps of:

a) using two or more scissors eye bolt assemblies with each of said scissors eye bolt assemblies having a pair of lower legs with each said pair of lower legs inserted through a void defined by an object to be lifted;

b) using a tee bar attached to two or more upper ends of two or more chains and using lower ends of the chains to attach to the two or more scissors eye bolt assemblies;

c) moving the tee bar to move the attached object to be lifted; and wherein each of the scissors eye bolt assemblies having two halves, with each half comprising:

i. an upper leg with the upper leg containing an eye void, ii. the lower leg comprising a support area, wherein the two halves of the scissor eye bolt assembly are pivotally connected within the support areas of the lower areas by use of a connector pin; a configuration of the upper legs with respect to the lower legs being such that when the two eye voids are aligned, the two support areas of the lower legs are in position to support an object to be lifted; the configuration of the upper legs with respect to the lower legs being such that the two upper legs may be spread apart to allow the lower legs to come into alignment, allowing the lower legs to enter a void area defined by the object to be lifted, with the void area having a diameter smaller than the diameter of the support areas of the lower legs created when the eye voids are aligned; and iii. a safety hook inserted into the eye voids.

8. The method of claim 7, further using a safety hook to attach to upper legs of each scissors eye bolt assembly and using the safety hook to attach to each lower end of chain.

9. A kit for moving objects, the kit comprising:

a) a scissors eye bolt assembly having two halves, with each half comprising:

i. an upper leg with the upper leg containing an eye void, ii. a lower leg with the lower leg comprising a support area, wherein the two halves of the scissor eye bolt assembly are pivotally connected within the support areas of the lower areas by use of a connector pin; a configuration of the upper legs with respect to the lower legs being such that when the two eye voids are aligned, the two support areas of the lower legs are in position to support an object to be lifted; the configuration of the upper legs with respect to the lower legs being such that the upper two legs may be spread apart to allow the lower legs to come into alignment, allowing the lower legs to enter a void area defined by the object to be lifted, with the void area having a diameter smaller than the diameter of the support areas of the lower legs created when the eye voids are aligned; and b) a safety hook inserted into the eye voids.

10. The kit of claim 9, further comprising one or more lengths of chain.

11. The kit of claim 9, further comprising one or more lengths of cable.

12. The kit of claim 9, further comprising one or more double clevis connectors.

13. The kit of claim 9, further comprising one or more shackles.

14. The kit of claim 9, further comprising one or more shaft collars.

15. The kit of claim 9, further comprising one or more single handles.

16. The kit of claim 9, further comprising one or more tee bars.

* * * * *